US005283616A

United States Patent [19]

Numagami et al.

[11] Patent Number: 5,283,616

[45] Date of Patent: Feb. 1, 1994

[54] DEVELOPING DEVICE HAVING BEARING FOR SUPPORTING A DEVELOPING ROLLER

[75] Inventors: Atsushi Numagami, Hadano; Kazuo Shishido, Yokohama, both of Japan

[73] Assignee: Canon Kabushiki Kaisha, Tokyo, Japan

[21] Appl. No.: 988,880

[22] Filed: Dec. 10, 1992

[30] Foreign Application Priority Data

Dec. 19, 1991 [JP] Japan ..... 3-354791

[51] Int. Cl.[5] ..... G03G 15/08

[52] U.S. Cl. ..... 355/245; 118/658; 355/251; 384/906

[58] Field of Search ..... 384/541, 906; 355/245, 355/251, 253; 118/651, 653, 656, 657, 658, 661

[56] References Cited

U.S. PATENT DOCUMENTS

| | | | |
|---|---|---|---|
| 4,046,432 | 9/1977 | Hofmann et al. | 384/906 X |
| 4,142,281 | 3/1979 | Müller | 118/658 X |
| 4,235,489 | 11/1980 | Schickling | 384/541 X |
| 4,395,109 | 7/1983 | Nakajima et al. | 219/216 |
| 4,639,119 | 1/1987 | Isaka | 355/260 X |
| 4,951,599 | 8/1990 | Damji | 118/657 |
| 5,040,779 | 8/1991 | Ogiri et al. | 384/906 X |
| 5,052,336 | 10/1991 | Fukuchi | 118/658 |

*Primary Examiner*—A. T. Grimley
*Assistant Examiner*—Robert Beatty
*Attorney, Agent, or Firm*—Fitzpatrick, Cella, Harper & Scinto

[57] ABSTRACT

A developing device includes a bearing member for rotatably supporting a developing roller for supplying developer to an electrostatic latent image and a holder for holding the bearing, which are positioned with respect to a container for containing the developer by use of a positioning member.

8 Claims, 5 Drawing Sheets

DEVELOPING DEVICE HAVING BEARING FOR SUPPORTING A DEVELOPING ROLLER

BACKGROUND OF THE INVENTION

1. Field of the Invention

The present invention relates to a developing device used in an image forming apparatus such as an electrophotographic copying machine, an electrophotographic laser beam printer and the like, and a process cartridge including an image bearing member and such developing device and removable with respect to the image forming apparatus.

2. Related Background Art

As shown in FIG. 4, a developing device 3 incorporated into a process cartridge C comprises a container 6 for containing toner therein, an agitating member 7 for agitating the toner in the container 6, a developing roller 9 arranged in parallel with an electrophotographic photosensitive member 1 and rotated in a direction shown by the arrow R1, a magnet roller 10 arranged within the developing roller 9, and an elastic blade 11 for regulating an amount of the toner which is fed out from the container 6 by the developing roller 9 and is conveyed toward a developing zone where an electrostatic image is developed.

As shown in FIG. 5, holders 12L, 12R are secured to left and right end walls of the container 6 of the developing device 3 by screws 13. (In the specification, the terms "left" and "right" are referred to with respect to a longitudinal direction of the developing roller.) The holders 12L, 12R have central supporting holes 15L, 15R, respectively, by which the magnet roller 10 is positioned at a fixed position. Further, the developing roller 9 is rotatably supported by the holders 12L, 12R via bearings 17L, 17R firmly fitted on inner peripheral supporting surfaces 16L, 16R of the holders 12L, 12R. The developing roller 9 comprises a cylindrical sleeve member 19, and flange members 20L, 20R secured to left and right ends of the sleeve member. Shaft portions of the flange members 20L, 20R are firmly fitted in the bearings 17L, 17R.

Further, between the left and right ends of the sleeve member 19, and the bearings 17L, 17R, there are disposed spacer rings 21L, 21R for regulating an undesired movement of the developing roller 9 in the left and right direction. Between the spacer rings, side seal members 22L, 22R made of felt or the like are disposed between the sleeve member 19 and the container 6 to seal the clearance between these members 19, 6. The side seal members 22L, 22R serve to prevent the toner in the container 6 from leaking toward both ends of the developing roller 9.

The developing roller 9 is driven via a gear 23 secured to the left flange member 20L. A rotational driving force is transmitted from a drive source (not shown) to the gear 23 via a transmitting mechanism (not shown). As shown in FIG. 4, the elastic blade 11 secured to the container 6 is elastically urged against the outer peripheral surface of the developing roller 9 along the longitudinal direction of the latter.

However, in the above-mentioned conventional technique, although the magnet roller 10 could be attached to the left and right holders 12L, 12R with high accuracy, it was difficult to mount the developing roller 9 within the left and right holders 12L, 12R and accordingly within the container 6 with high accuracy, with the result that it was feared that the delicate vibration in the rotation of the developing roller 9 arose.

Incidentally, the poor mounting accuracy of the developing roller 9 with respect to the container 6 is caused by the delicate clearance (assembling allowance) between the holders 12L, 12R and the bearings 17L, 17R. That is to say, it is necessary to provide a moderate clearance, which may be minimum, for permitting the assembling and disassembling, between the outer peripheral surfaces of the bearings 17L, 17R and the inner peripheral supporting surfaces (fitting surfaces) 16L, 16R of the holders 12L, 12R, and this clearance causes the vibration during the rotation of the developing roller 9. However, if such clearance is omitted, the assembling and disassembling operations will be made troublesome and difficult; to the contrary, the provision of such clearance worsens the accuracy of the rotation of the developing roller 9.

Due to the above-mentioned vibration or play, the positioning accuracy of the developing roller 9 with respect to the magnet roller 10, elastic blade 11, side seal members 22L, 22R and the photosensitive member 2 is worsened, thus generating the poor accurate positionings regarding the latters, which cause the unevenness in application of toner t onto the developing roller 9, the unevenness in thickness of a layer of the toner t, leakage of the toner t, and the unevenness in a toner image on the photosensitive member 2, respectively. Further, the unevenness in the quality of a copied image and the penetration of the toner t into undesired zones are caused.

SUMMARY OF THE INVENTION

An object of the present invention is to provide a developing device which is simple in construction and wherein a developing roller can be positioned at a predetermined position with high accuracy.

Another object of the present invention is to provide a developing device which is simple in construction and wherein a developing roller can be arranged in a very accurate positional relation to other members associated with the developing roller.

A further object of the present invention is to provide a developing device which is simple in construction and wherein a developing roller can be positioned at a predetermined position with high accuracy in such a manner that assembling plays are provided between bearing members for rotatably supporting the developing roller and holder members therefor.

A still further object of the present invention is to provide a process cartridge which incorporates therein a developing device having a developing roller positioned with high accuracy.

The other objects and features of the present invention will be apparent from the following explanation.

DETAILED DESCRIPTION OF THE PREFERRED EMBODIMENTS

First of all, an image forming apparatus which can be used with the present invention will be explained with reference to FIG. 4.

Figure 4:
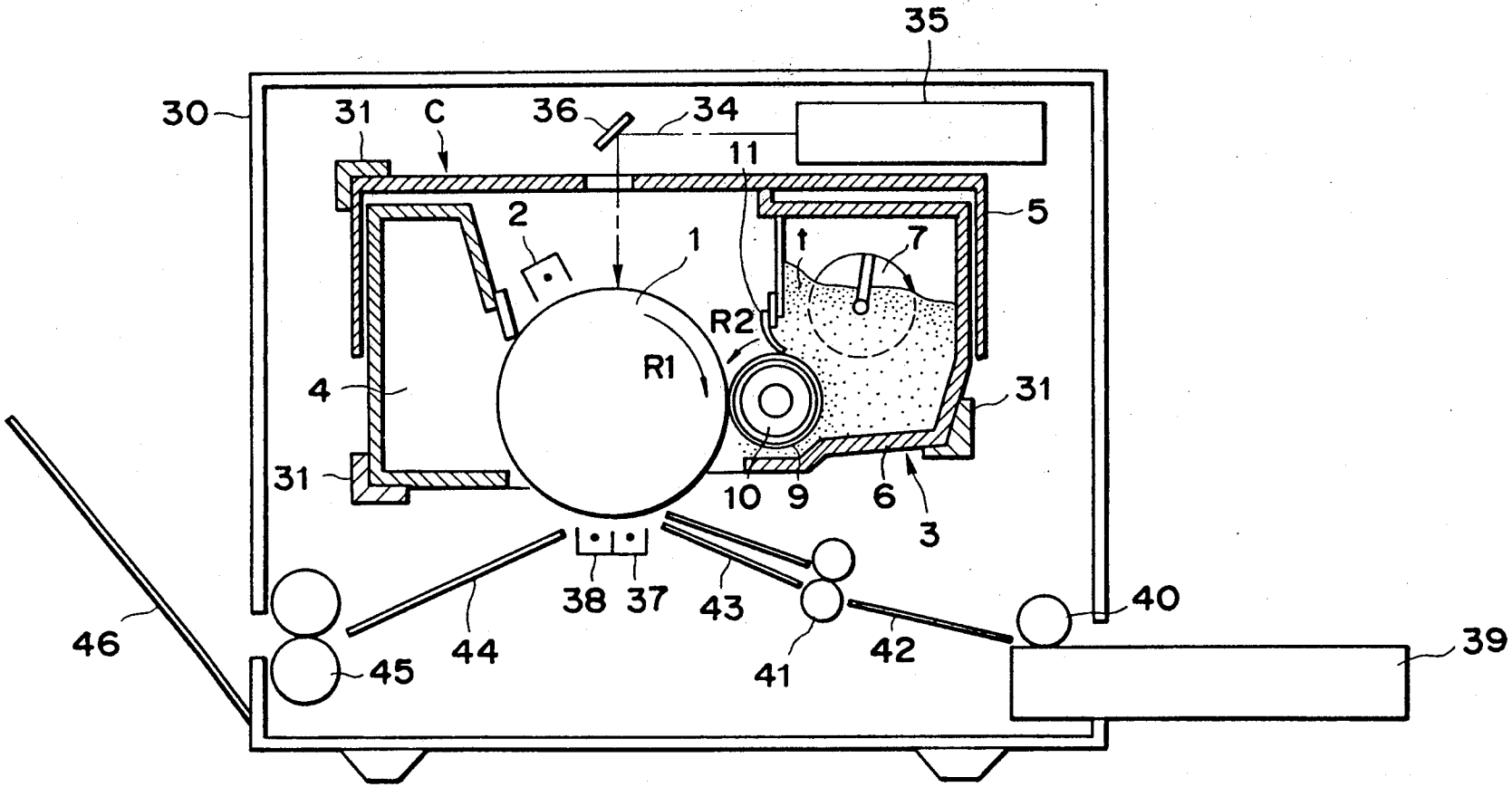
FIG. 4 is a schematic elevational sectional view of an image forming apparatus and a process cartridge to which the present invention can be applied.
Figure 5:
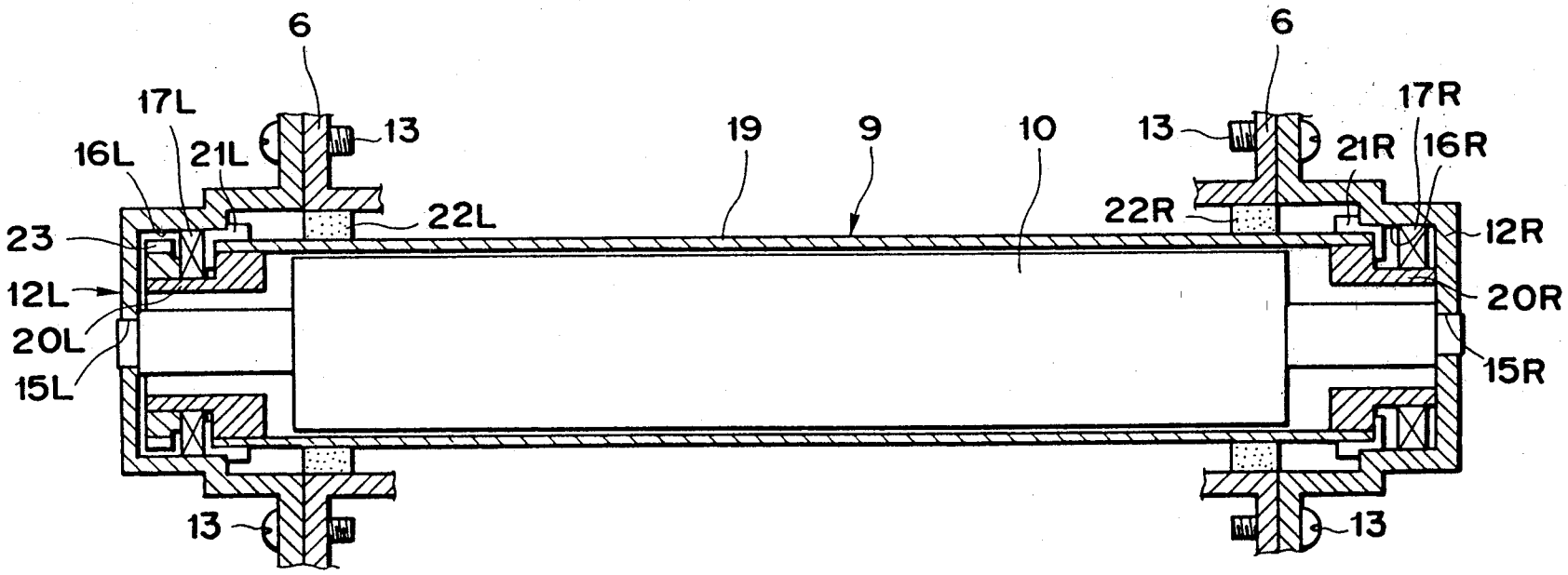
FIG. 5 PRIOR ART
FIG. 5 is a longitudinal sectional view of a developing roller of a conventional developing device.

In FIG. 4, the image forming apparatus 30 includes an optical system, a transfer sheet conveying device, a transfer device, a fixing device, and guide members 31 for guiding the mounting and dismounting of a process cartridge C with respect to the image forming apparatus 30, which devices will be fully described later.

The process cartridge C includes an electrophotographic photosensitive member (photosensitive drum) 1 rotated in a direction shown by the arrow R1, a charger 2 for uniformly charging the photosensitive member 1, a developing device 3 for developing an electrostatic latent image formed on the photosensitive member 1, and a cleaning device 4 for removing the residual toner remaining on the photosensitive member 1 after a developed image has been transferred, and these devices and the like are supported by a frame 5. The process cartridge can be withdrawn from and inserted into the image forming apparatus 30 by sliding the cartridge along the guide members 31 in a direction perpendicular to the plane of FIG. 4. Thus, when the toner in the developing device 3 is used up, an operator can remove the process cartridge C from the image forming apparatus 30 and insert a new process cartridge C including a developing device containing fully loaded toner into an image forming station of the image forming apparatus 30. Further, by mounting a process cartridge C including desired color toner within the image forming apparatus 30, a desired color image can be obtained.

Next, an image forming operation will be explained. First of all, the photosensitive member 1 is charged by the charger 2 and then is scanned and exposed by a laser beam 34 modulated in response to a signal corresponding to image information to be copied, thereby forming an electrostatic latent image on the photosensitive member. The laser beam 34 is generated by a conventional optical system 35 comprising a semiconductor laser, a rotatable polygon mirror, an f-$\theta$ lens and the like, and is reflected by a mirror 36 toward the photosensitive member 1.

The electrostatic latent image is developed by the developing device 3 to form a toner image. The toner image is transferred onto a transfer sheet such as a paper sheet by means of a transfer charger 37. Then, the transfer sheet is separated from the photosensitive member 1 by a separating discharger 38.

The transfer sheet conveying device comprises a cassette 39 containing the transfer sheets therein, a pick-up roller 40 for feeding the transfer sheet out of the casstte 39, a pair of register rollers 41 for conveying the transfer sheet to a transfer station in registration with the movement of the toner image, and convey guides 42, 43, 44.

The transfer sheet separated from the photosensitive member 1 is sent, via a guide 44, to a fixing device 45, where the toner image is fixed to the transfer sheet. After the fixing operation, the transfer sheet is discharged onto a tray 46.

Incidentally, in the illustrated embodiment, while the photosensitive member 1 was exposed by the laser beam, the photosensitive member may be exposed by light emitted from a light emitting diode array driven by an image signal or may be exposed directly by image light from an original via a lens.

Further, while the process cartridge included the charger 2 and the cleaning device 4, one or both of them may be omitted from the process cartridge and may be attached to the image forming apparatus 30.

Now, as shown in FIG. 4, the developing device 3 has a container 6 for containing toner (developer) t. The container 6 includes therein and rotatably supports an agitating member 7 for agitating the toner, and a developing roller 9 rotated in a direction shown by the arrow R2 and a magnet roller (magnet member) 10 are arranged at a lower opening of the container.

Figure 1:
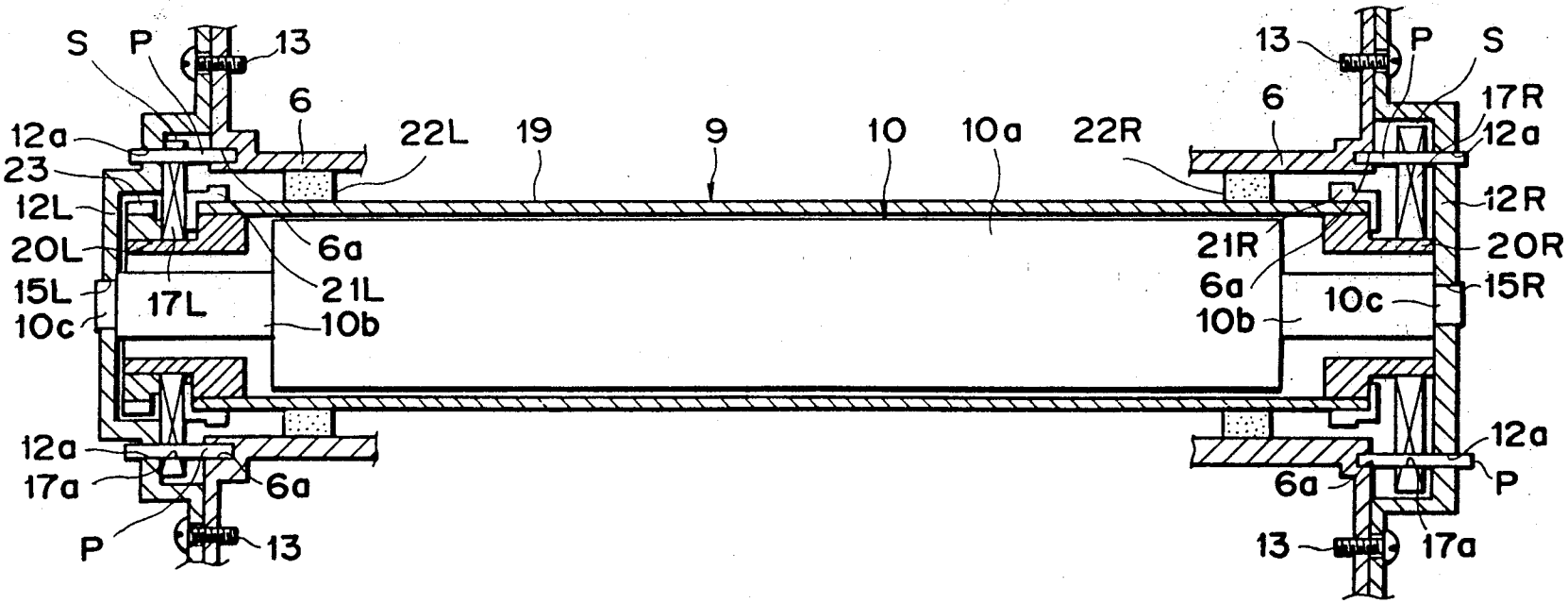
FIG. 1 is a longitudinal sectional view of a developing roller of a developing device according to a first embodiment of the present invention.

As shown in FIG. 1, the magnet roller 10 is supported by holders 12L, 12R secured to left and right end wall of the container 6. The holders 12L, 12R are secured to the container 6 by screws 13. Holes formed in the holders 12L, 12R, through which the screws 13 pass, have diameters slightly greater than those of threaded portions of the screws, so as to permit the positioning of the holders 12L, 12R and bearings 17L, 17R with respect to the container 6. Such positioning is effected by a positioning means which will be described later.

The holders 12L, 12R are provided with holes 12*a* in registration with holes 6*a* formed in the container 6. Pin members P passing through holes 17*a* formed in the bearing members 17L, 17R are fitted into the holes 6*a*, 12*a*. Thus, the holders 12L, 12R are positioned accurately with respect to the container 6 by the pin members P.

The magnet roller 10 is secured and positioned by supporting holes 15L, 15R formed in the holders 12L, 12R. The magnet roller 10 has a cylindrical central portion 10*a* which is provided at its outer peripheral surface with a plurality of magnetic poles, and shaft portions 10*b* projecting from both ends of the central portion 10*a* in coaxial with the latter. The magnet roller is positioned by the holders 12L, 12R by fitting boss portions 10*c* projecting from the shaft portions 10*b* into the supporting holes 15L, 15R.

The developing roller 9 covering substantially the whole length of the magnet roller 10 comprises a cylindrical non-magnetic sleeve member 19, and flange members 20L, 20R secured to left and right ends of the sleeve member 19. The sleeve member 19 has an inner peripheral surface having a diameter slightly greater than a diameter of an outer peripheral surface of the central portion 10*a* of the magnet roller 10, so that a small uniform clearance is formed between these surfaces. Further, reduced shaft portions of the flange members 20L, 20R at both ends of the developing roller are fitted into the sliding bearings 17L, 17R made of molded PBT resin or the like.

The bearings 17L, 17R are positioned with respect to the container 6 by the pin members P passing through the holes 17*a* of the bearings and fitted into the holes of the container 6 and the holders 12L, 12R. Accordingly, similar to the holders 12L, 12R, the positional accuracy of the bearings 17L, 17R with respect to the container 6 is ensured by the pin members P. Incidentally, moderate small assembling plays or spaces S are provided between outer peripheral surfaces of the bearings 17L, 17R and inner peripheral surfaces of the holders 12L, 12R, thereby improving the operability regarding the assembling and disassembling of the developing roller 9 and the like. That is to say, by providing the spaces S, it is possible to easily insert the bearings 17L, 17R into the holders 12L, 12R and to easily withdraw the bearings from the holders.

Incidentally, the number of the pin members P regarding each holder 12L, 12R may be appropriately selected at need, but should be two or more. In any way, after the holders 12L, 12R and the bearings 17L, 17R have been positioned by the pin members P, the holders 12L, 12R are secured to side walls of the container 6 by the screws 13.

Further, spacer rings 21L, 21R for regulating an undesired movement of the whole developing roller 9 in the left and right (i.e., axial) direction are mounted on left and right ends of the sleeve member 19 of the developing roller 9. Between and near the spacer rings 21L, 21R, side seal members 22L, 22R made of felt, moltprene or the like are secured to the container 6 in such a manner that the seal members are slidingly contacted with an outer peripheral surface of the sleeve member 19. Side seal members 22L, 22R serve to prevent the toner in the container 6 from leaking toward the ends of the developing roller and entering into the bearings and the spacer rings.

The developing roller 9 is rotatingly driven via a gear 23 secured to the left flange member 20L. When the process cartridge is mounted within the image forming apparatus 30, the gear 23 is operatively connected to a drive source (not shown) via a transmitting mechanism (not shown) and is rotatingly driven by energizing the drive source. Consequently, the developing roller 9 rotatably supported by the left and right bearings 17L, 17R is rotated.

In summary, the left and right holders 12L, 12R and the left and right bearings 17L, 17R are positioned with respect to the container 6 by the pin members P, and thus, the positional accuracy of these elements with respect to the container 6 is very high. Since the magnet roller 10 and the developing roller 9 are positioned by the holders 12L, 12R and the bearings 17L, 17R, respectively, the rollers can be positioned accurately with respect to the container 6 by the holders and bearings. Further, the side seal members 22L, 22R and the elastic blade 11 are secured to the container 6 itself. Accordingly, the positional relationship between the above-mentioned elements is maintained with high accuracy.

On the basis of the above fact, the rotation of the developing roller 9 becomes accurate with respect to the magnet roller 10, side seal members 22L, 22R and elastic blade 11, thus providing the advantages that the amount of toner t attracted on the surface of the developing roller 9 by the magnet roller 10 becomes uniform, that the toner is prevented from leaking between the side seal members 22L, 22R and the developing roller 9, and that the elastic blade 11 makes a thickness of the toner layer on the developing roller 9 uniform.

When the above-mentioned developing device 3 is mounted within the process cartridge C as shown in FIG. 4, so long as the container 6 is attached to the process cartridge C with high accuracy, it is possible to enhance the accuracy in the relative positional relation between elements of the developing device 3 including the developing roller 9 and elements of the process cartridge C (excluding the elements of the developing device 3) including the photosensitive member 1. As a result, the toner can be suppled from the developing device 3 to the photosensitive member 1 in a best manner, thereby effectively preventing the unevenness in the copied image from occurring and the toner from entering into the undesired zones.

Figure 2:
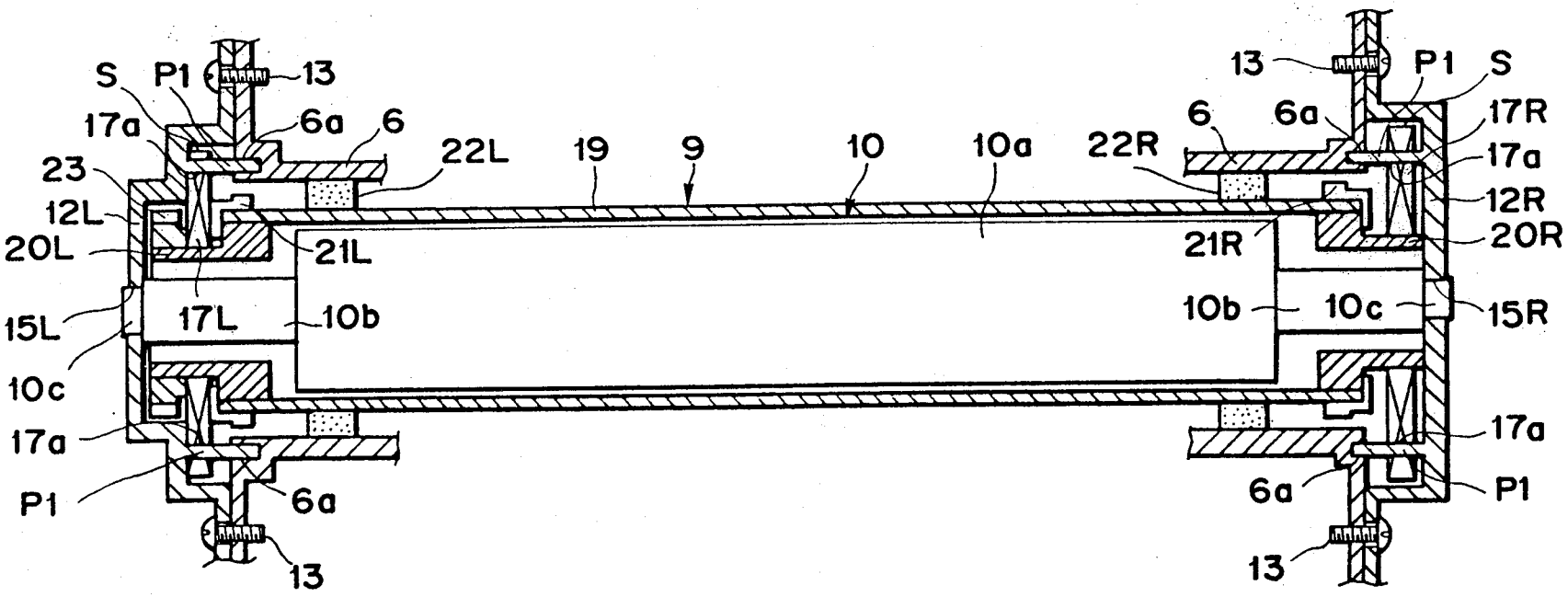
FIG. 2 is a longitudinal sectional view of a developing roller of a developing device according to a second embodiment of the present invention.
Figure 3:
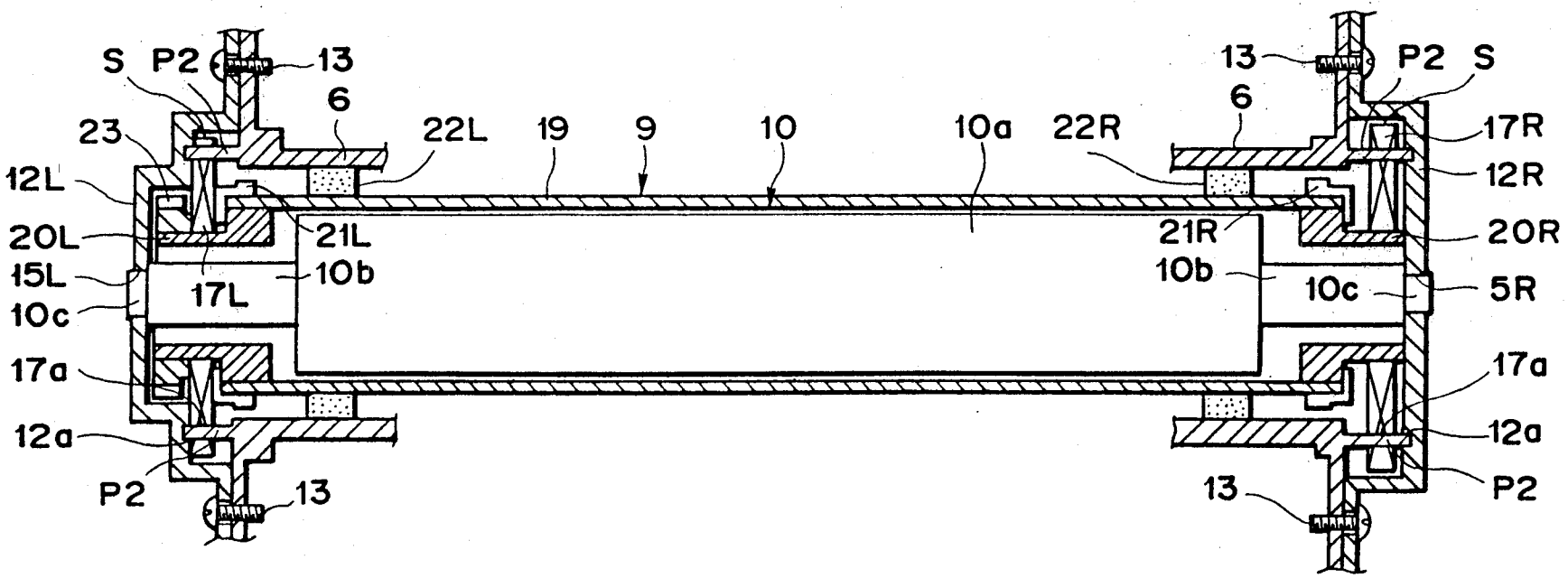
FIG. 3 is a longitudinal sectional view of a developing roller of a developing device according to a third embodiment of the present invention.

In the above-mentioned first embodiment, while the pin members P were formed separately from the holders and the container, in a second embodiment as shown in FIG. 2, pin members Pl may be formed integrally with holders, and in a third embodiment as shown in FIG. 3, pin members P2 may be formed integrally with a container.

More particularly, in FIG. 2, positioning pin members P1 are molded integrally with holders 12L, 12R. Material for the holders and pin members may be, for example, ABS resin or the like containing therein glass fibers. The pin members P1 projecting from the corresponding holders 12L, 12R are fittingly passed through holes **17*a* formed in bearings 17L, 17R and are fitted into holes 6*a* formed in side walls of a container 6**.

In this way, the holders and the bearings are positioned with respect to the container, thereby supporting a developing roller and a magnet roller in place with high accuracy.

In FIG. 3, positioning pin members P2 are molded integrally with a container 6. Material for the container and pin members may be, for example, high impact styrol resin. The pin members P2 projecting from side walls of the container 6 are fittingly passed through holes **17*a* formed in bearings 17L, 17R and are fitted into holes 12*a* formed in side holders 12L, 12R**.

In this way, the same advantage as that of FIG. 2 can be obtained.

Incidentally, developing devices of FIGS. 2 and 3 can also be incorporated into the process cartridge as shown in FIG. 4.

In the illustrated embodiments, while the thickness of the layer of the toner fed to the developing station by the developing roller was regulated by the elastic blade elastically urged against the developing roller, the thickness of the toner layer may be regulated by a blade arranged in a confronting relation to the developing roller with a gap therebetween.

Further, in the illustrated embodiments, while one-component magnetic toner was used as the developer, the present invention may be applied to a developing device utilizing two-component developer or a developing device utilizing one-component non-magnetic developer. When the one-component non-magnetic developer is utilized, the magnet roller is omitted.

What is claimed is:

1. A developing device, comprising:

a container for containing developer therein;

a developing roller for feeding out the developer from said container and for supplying the developer to an electrostatic latent image;

a bearing member for rotatably supporting said developing roller;

a holder member for holding said bearing member;

a positioning member for positioning said holder member and said bearing member with respect to said container, wherein said positioning member comprises a pin-shaped member formed integrally with said holder member, and said bearing member and said container have engagement portions by which said pin-shaped member is engaged; and a securing member for securing said holder member to said container.

2. A developing device, comprising:

a container for containing developer therein;

a developing roller for feeding out the developer from said container and for supplying the developer to an electrostatic latent image;

a bearing member for rotatably supporting said developing roller;

a holder member for holding said bearing member;

a positioning member for positioning said holder member and said bearing member with respect to said container, wherein said positioning member comprises a pin-shaped member formed integrally with said container, and said holder member and said bearing member have engagement portions by which said pin-shaped member is engaged; and a securing member for securing said holder member to said container.

3. A developing device according to claim 1, further comprising a magnet roller disposed within said developing roller, and wherein said holder member has a supporting portion for said magnet member.

4. A developing device according to claim 2, further comprising a magnet roller disposed within said developing roller, and wherein said holder member has a supporting portion for said magnet member.

5. A process cartridge, removably mountable within an image forming apparatus, comprising:

a frame;

an image bearing member supported by said frame;

a developing device supported by said frame and adapted to develop an electrostatic latent image formed on said image bearing member, said developing device comprising a container for containing developer therein, a developing roller for feeding out the developer from said container and for supplying the developer to the electrostatic latent image, a bearing member for rotatably supporting said developing roller, a holder member for holding said bearing member, a positioning member for positioning said holder member and said bearing member with respect to said container wherein said positioning member comprises a pin-shaped member formed integrally with said holder member, and said bearing member and said container have engagement portions by which said pin-shaped member is engaged; and a securing member for securing said holder member to said container.

6. A process cartridge removably mountable within an image forming apparatus, comprising:

a frame;

an image bearing member supported by said frame;

a developing device supported by said frame and adapted to develop an electrostatic latent image formed on said image bearing member, said developing device comprising a container for containing developer therein, a developing roller for feeding out the developer from said container and for supplying the developer to the electrostatic latent image, a bearing member for rotatably supporting said developing roller, a holder member for holding said bearing member, a positioning member for positioning said holder member and said bearing member with respect to said container wherein said positioning member comprises a pin-shaped member formed integrally with said container, and said holder member and said bearing member have engagement portions by which said pin-shaped member is engaged; and a securing member for securing said holder member to said container.

7. A process cartridge according to claim 5, further comprising a magnet roller disposed within said developing roller, and wherein said holder member has a supporting portion for said magnet member.

8. A process cartridge according to claim 6, further comprising a magnet roller disposed within said developing roller, and wherein said holder member has a supporting portion for said magnet member.

* * * * *

UNITED STATES PATENT AND TRADEMARK OFFICE

CERTIFICATE OF CORRECTION

PATENT NO. : 5,283,616

DATED : February 1, 1994

INVENTOR(S) : Atsushi Numagami, et al.

It is certified that error appears in the above-indentified patent and that said Letters Patent is hereby corrected as shown below:

COLUMN 5:

Line 67, "suppled" should read --supplied--.

COLUMN 7:

Line 39, "container" should read --container,--.

COLUMN 8:

Line 23, "container" should read --container,--.

Signed and Sealed this

Sixteenth Day of August, 1994

Bruce Lehman

*Attest:*

BRUCE LEHMAN

*Attesting Officer*

*Commissioner of Patents and Trademarks*